US011198593B2

(12) United States Patent
Vroegindeweij et al.

(10) Patent No.: US 11,198,593 B2
(45) Date of Patent: Dec. 14, 2021

(54) STAIRLIFT CARRIAGE AND A STAIRLIFT

(71) Applicant: DEVI-GROUP BV, Obdam (NL)

(72) Inventors: Dennis Vroegindeweij, Hensbroek (NL); Thijmen Johannes Groot, Noord-Scharwoude (NL)

(73) Assignee: DEVI-GROUP BV, Obdam (NL)

( * ) Notice: Subject to any disclaimer, the term of this patent is extended or adjusted under 35 U.S.C. 154(b) by 23 days.

(21) Appl. No.: 16/765,782

(22) PCT Filed: Nov. 26, 2018

(86) PCT No.: PCT/NL2018/050792
§ 371 (c)(1),
(2) Date: May 20, 2020

(87) PCT Pub. No.: WO2019/103614
PCT Pub. Date: May 31, 2019

(65) Prior Publication Data

US 2020/0290844 A1 Sep. 17, 2020

(30) Foreign Application Priority Data

Nov. 24, 2017 (NL) ..... 2019975

(51) Int. Cl.
*B66B 9/08* (2006.01)

(52) U.S. Cl.
CPC ..... *B66B 9/0815* (2013.01); *B66B 9/0846* (2013.01)

(58) Field of Classification Search
CPC ..... B66B 9/0815; B66B 9/0807; B66B 9/08; B66B 9/0846
See application file for complete search history.

(56) References Cited

U.S. PATENT DOCUMENTS

| | | | | |
|---|---|---|---|---|
| 5,908,087 | A * | 6/1999 | Johansson | B66B 9/0838 187/201 |
| 6,082,496 | A * | 7/2000 | Bovis | B66B 9/0815 105/149 |
| 6,155,382 | A * | 12/2000 | Duijnstee | B66B 9/0838 187/200 |
| 6,712,192 | B1 * | 3/2004 | Hester | B66B 9/0815 187/201 |
| 2002/0074189 | A1 * | 6/2002 | Hester | B66B 9/08 187/201 |
| 2004/0104078 | A1 * | 6/2004 | Szentistvany | B66B 9/0846 187/201 |
| 2004/0238286 | A1 * | 12/2004 | Vroegindeweij | B66B 9/0846 187/277 |

(Continued)

FOREIGN PATENT DOCUMENTS

| | | |
|---|---|---|
| EP | 1614650 A2 | 1/2006 |
| WO | 02/05617 A1 | 1/2002 |

*Primary Examiner* — Michael A Riegelman
(74) *Attorney, Agent, or Firm* — Maschoff Brennan

(57) ABSTRACT

A stairlift for conveying a load along a staircase includes a stairlift guide (stairlift rail), a carriage carried by the stairlift guide and moveable along the stairlift guide, the carriage comprising a carriage drive to drive the carriage along the stairlift guide. A stairlift carriage with reduced energy consumption comprises a body of revolution mounted hingably about a first axis to a frame of the stairlift carriage, while being able to rotate about an axis of rotation at a distance from said first axis.

20 Claims, 13 Drawing Sheets

(56) References Cited

U.S. PATENT DOCUMENTS

| | | | | |
|---|---|---|---|---|
| 2005/0279580 | A1* | 12/2005 | Szentistvany | B66B 9/0838 187/201 |
| 2007/0235265 | A1* | 10/2007 | Vroegindeweij | B66B 9/0838 187/201 |
| 2008/0271953 | A1* | 11/2008 | Vroegindeweij | B66B 9/0838 187/245 |
| 2011/0024237 | A1* | 2/2011 | Vroegindeweij | B66B 9/0838 187/201 |
| 2012/0048652 | A1* | 3/2012 | DiGiovanni | B66B 9/0846 187/201 |
| 2012/0261216 | A1* | 10/2012 | Hrenchir | B66B 9/0846 187/201 |
| 2014/0083801 | A1* | 3/2014 | Vroegindeweij | B66B 9/08 187/201 |
| 2014/0151157 | A1* | 6/2014 | Hall | B66B 9/0807 187/202 |
| 2015/0034423 | A1* | 2/2015 | Ooms | B66B 9/0846 187/201 |
| 2017/0144860 | A1* | 5/2017 | Colenutt | B66B 9/0815 |
| 2017/0158464 | A1* | 6/2017 | De Kroon | B66B 9/0838 |
| 2017/0233223 | A1* | 8/2017 | Hoedjes | B66B 9/08 187/201 |
| 2017/0247227 | A1* | 8/2017 | Rosenthal | B66B 9/0838 |
| 2020/0290844 | A1* | 9/2020 | Vroegindeweij | B66B 9/0815 |
| 2020/0361748 | A1* | 11/2020 | Vroegindeweij | B66B 7/023 |

* cited by examiner

STAIRLIFT CARRIAGE AND A STAIRLIFT

The present invention relates to a stairlift carriage for moving along a stairlift guide, said stairlift carriage having a first side for facing an upwardly inclined stairlift guide section of the stairlift guide, a second side for facing a downwardly inclined stairlift guide section of the stairlift guide, if the stairlift carriage is mounted on the stairlift guide; said stairlift carriage comprising a carriage drive, and a frame, said frame being provided with a platform for carrying a load, a pair of guide wheels for following the stairlift guide, said guide wheels being spaced apart in a direction from the first side to the second side of the stairlift carriage, and a body of revolution for moving along the stairlift guide if the stairlift carriage is mounted on the stairlift guide by contact with the stairlift guide and driven by the carriage drive, said body of revolution having an axis of rotation.

Stairlifts are devices for transporting a load, typically a human being, between two floors of a building, for example along a flight of stairs of a building lacking an elevator such as a home. A stairlift for conveying a load along a staircase includes a stairlift guide (stairlift rail), a carriage carried by the stairlift guide and moveable along the stairlift guide, the carriage comprising a carriage drive to drive the carriage along the stairlift guide.

The stairlift guide may comprise a toothed track allowing the carriage to engage the stairlift guide or the stairlift carriage relies on friction. A disadvantage of a toothed track is that the body of revolution has to be kept in proper contact with the stairlift guide, which is in particular difficult to accommodate for if curves in the stair lift guide are present, which are often necessary in a home with a curved stairwell. To overcome this problem, stairlifts are known that don't rely on a toothed track but on friction. A stairlift guide of this type is disclosed in EP3153453.

A disadvantage of a friction-based stairlift is that the energy consumption can be relatively high due to the friction.

The object of the present invention is to provide a stairlift carriage allowing for a reliable engagement of the body of revolution and the stairlift guide.

To this end, a stairlift carriage according to the preamble is characterized in that the frame is provided with an arm having a primary arm section and a secondary arm section, the arm being at the primary arm section pivotably about a first axis connected to the frame and the body of revolution being rotatably about its axis of rotation connected to the secondary arm section, said first axis being parallel to the axis of rotation of the body of revolution, wherein said first axis is relatively close to the first side and the axis of rotation of the body of revolution is relatively far away from the first side;

the relative positions of the axis of rotation of the body of revolution and of the first axis are chosen such that if the stairlift carriage is mounted on a horizontal straight stairlift guide the first axis is at a larger distance from a reference plane defined by a first line of contact of the body of revolution with the stairlift guide when the carriage is at a first position on a horizontal straight stairlift guide, and a second line of contact of the body of revolution with the stairlift guide when the carriage is at a second position on the horizontal straight stairlift guide;

than the axis of rotation of the body of revolution.

In use, with the stairlift carriage according to the present invention moving in a direction from the second side to the first side, the body of revolution such as a friction roll will try to be wedged between the stairway guide and the first axis, thus effectively exerting an upward force on the frame and conversely a downward force of the friction roll agains the stairway guide. If there is a load on the stairlift carriage it will oppose this force in dependence of the weight of the load. When moving in the opposite direction, the opposite occurs, but that is the direction in which the stairlift carriage moves downward. In that case, the frame of the stairlift carriage will try to overtake the friction roll which is using engine braking to prevent acceleration and thus the friction roll is similarly pressed against the stairlift guide with a force that is dependent on the weight of the load if the stairlift carriage.

If the curvature of the stairlift guide displays a variety of inclination, for example it comprises two horizontal sections for the start and end of the stairlift guide and an inclined section in between, the amount of friction is higher on the inclined section to ensure reliability and safety and lower on the horizontal sections, thus saving energy.

The friction roll may comprise, for example a single roll or a plurality of friction wheels. In case of a multitude of friction wheels having one or more axes of rotation that are not shared, the multitude of friction wheels will be mounted on a friction roll frame, which friction roll frame will be rotatable about an axis of rotation so as to follow any curvature involving a change in inclination of the stairway guide. In that case, that is the axis of rotation referred to in the claims.

According to a favourable embodiment, the arm is at an angle to the reference plane between 30° and 60°, preferably between 40° and 50°.

This has been found to give the most satisfactory load-dependent engagement, in particular in case of friction control. The arm is defined by a line through the first axis and the axis of rotation of the friction roll in case the body of revolution is a friction roll.

According to a favourable embodiment, the body of revolution is a wheel comprising a tread, said tread being provided with spaced-apart knobs.

Spaced apart means there is tread surface between the knobs. The body of revolution may be referred to as a pinion wheel. The knobs preferably comprise a tapered distal end section for easy insertion into corresponding holes in the stairlift guide. A proximal section of the knobs is preferably cylindrical so as to allow the force exerted by the knob on the stairlift guide in a direction along the longitudinal axis of the stairlift guide at the particular location of the stairlift guide.

According to a favourable embodiment, the body of revolution is a friction roll.

Stairlifts are known in the art that rely on friction. A stairlift guide of this type is disclosed in EP3153453.

A disadvantage of a friction-based stairlift is that the energy consumption can be relatively high due to the friction.

In accordance with this embodiment, the present invention provides a stairlift carriage allowing for a reduction in the amount of energy necessary for conveying a load along a stairlift guide.

According to a favourable embodiment, the body of revolution is provided with a pre-tension spring.

This provides for a minimum amount of force exerted by the friction roll on the stairlift guide, avoiding slippage of the body of revolution such as the friction roll when driven using the carriage drive.

According to a favourable embodiment, the stairlift carriage is designed such that if said stairlift carriage is mounted on a straight stairlift guide inclined to the horizontal at an angle $\alpha$, the first axis is directly above the axis of rotation of the friction roll, wherein $\alpha$ is more than 40° and less than 70°.

In use, with the stairlift carriage according to the present invention, the body of revolution such as the friction roll will be pressed against the stairlift guide with a force that is dependent on the weight of the load if the stairlift carriage passes a stairlift section at an angle to the horizontal of more than $\alpha$. For a relatively light person, less force is used saving energy. For a stairlift guide with varying inclination thereof, the force will depend on the angle of the stairlift guide, with angles larger than 40° resulting in a larger force of the body of revolution such as the friction roll pressing against the stairlift guide. Thus, the amount of force is varied depending on what is necessary, saving energy. Also, the amount of force is varied passively, saving cost and/or improving reliability and/or safety.

According to a favourable embodiment, the friction roll comprises an elastomeric surface for contact with the stairlift guide.

Thus the friction can be increased and/or decreased reliably. For example, the friction roll comprises a circumferentially extending elastomeric layer.

Finally, the present invention relates to a stairlift comprising a stairlift guide, a stairlift carriage supported by the stairlift guide and moveable along the stairlift guide, said carriage comprising a carriage drive to drive the carriage along the stairlift guide; wherein the stairlift carriage is a stairlift carriage according to any of the claims 1 to 7.

Thus an energy-efficient stairlift system is provided.

According to a favourable embodiment, the pair of guide wheels is a first pair of guide wheels, and the stairlift carriage comprises a second pair of guide wheels opposite of the first pair of guide wheels, the first pair of guide wheels and second pair of guide wheels capable of carrying the stairlift carriage when mounted on a horizontal straight stairlift guide section.

Thus the weight of the load does not affect the force of the friction roll against the stairlift guide, saving energy.

The present invention will now be illustrated with reference to the drawing where FIG. 1A to FIG. 1C show a front view, a side view and a rear view of a stairlift carriage on a stairlift guide;

FIG. 1*d* shows a top view of a detail of stairlift carriage on a stairlift guide of FIG. 1A;

Figure 1A:
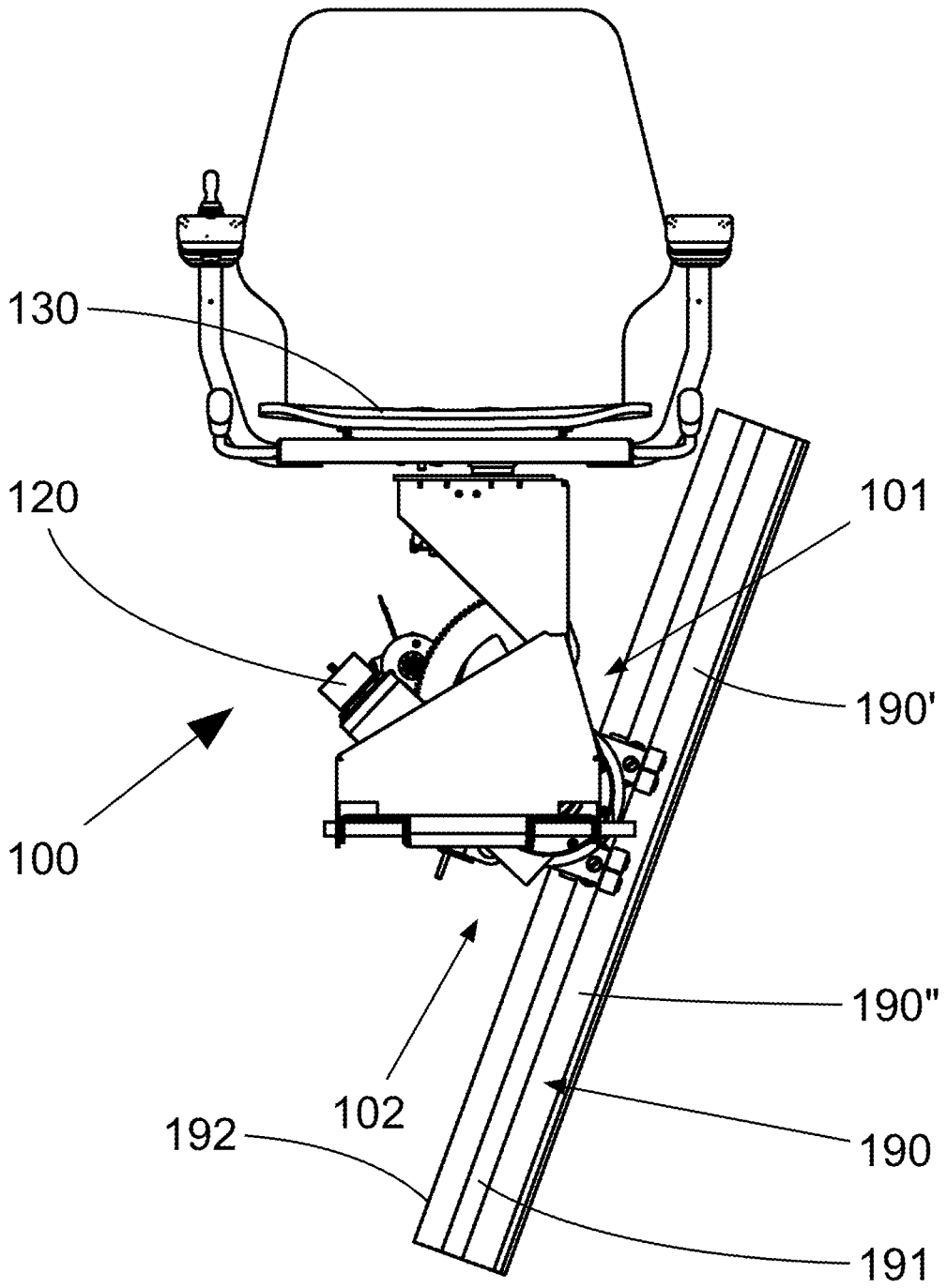
Figure 1B:
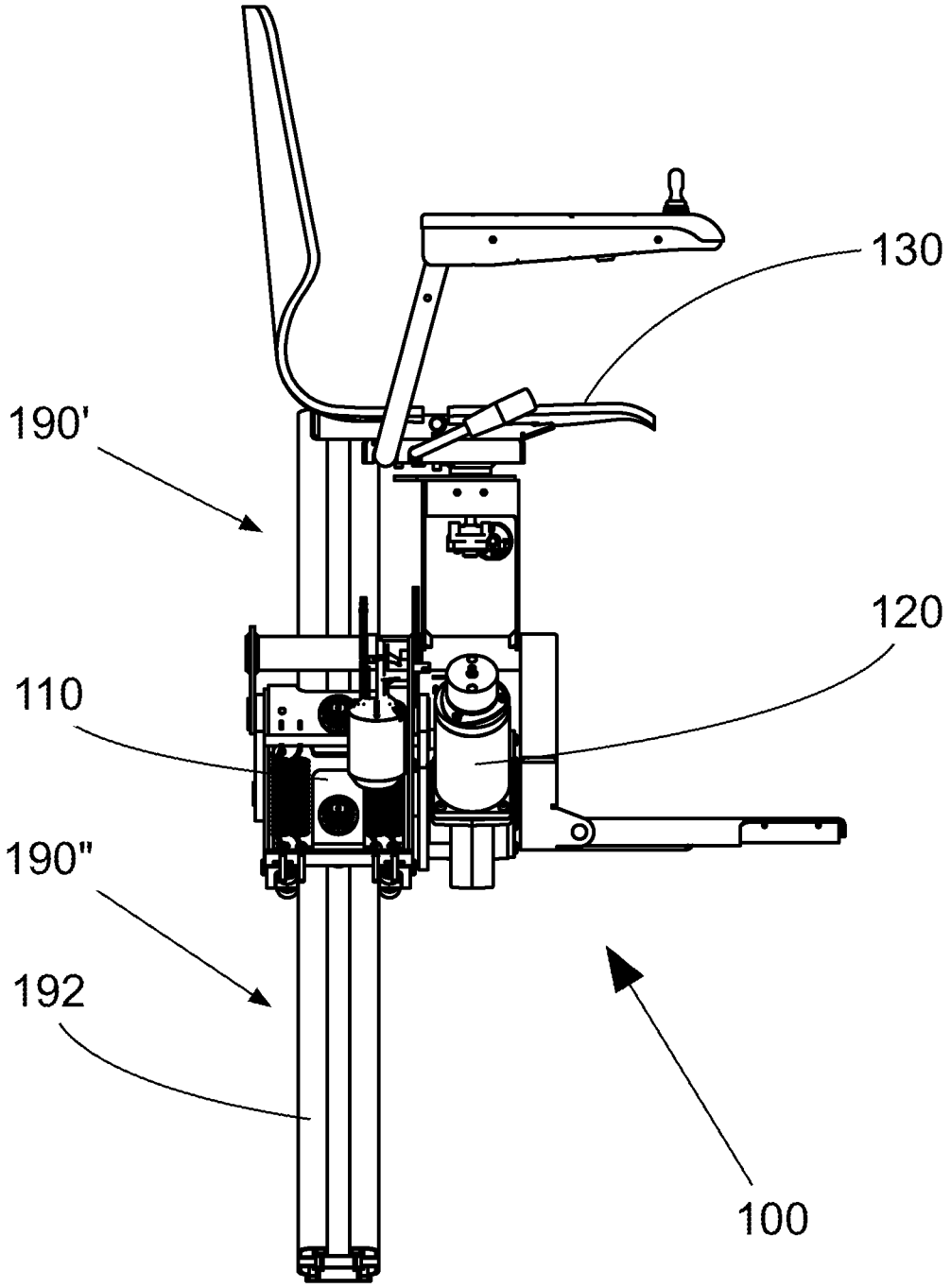
Figure 1C:
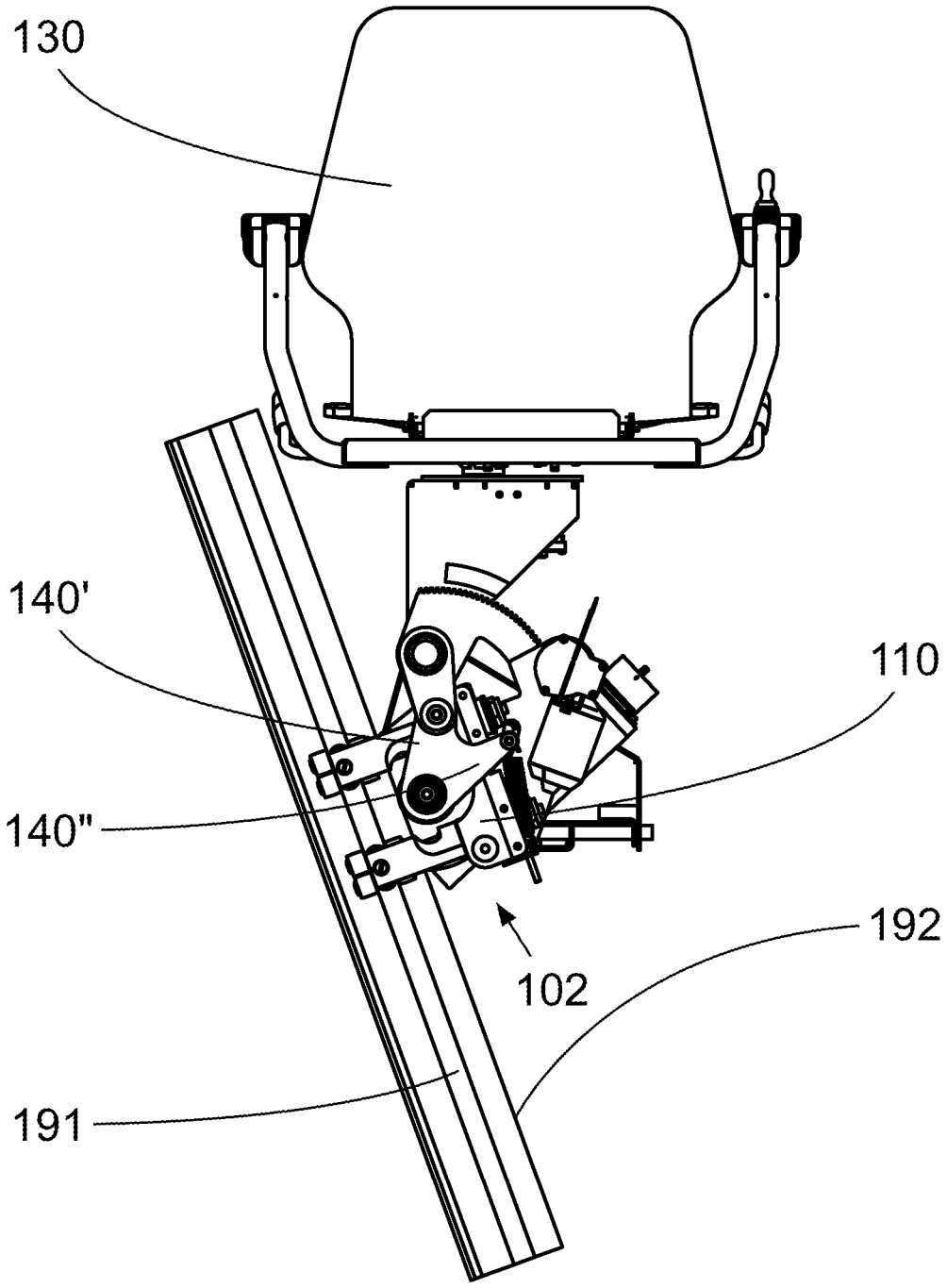

FIG. 1A to FIG. 1C show a front view, a side view and a rear view of a stairlift carriage 100 mounted on a stairlift guide 190. The stairlift guide 190 comprises grooves 191 at opposite sides thereof and guide wheels of stairlift carriage 100 contact the opposite sides and the grooves 191 to keep the stairlift carriage 100 on the stairlift guide 190. This is discussed in further detail below with reference to FIG. 3, but essentially this is known from the prior art.

The stairlift carriage 100 comprises a first side 101 for facing an upwardly inclined stairlift guide section 190' of the stairlift guide 190, and ii) a second side 102 for facing a downwardly inclined stairlift guide section 190" of the stairlift guide 190.

The stairlift carriage 100 comprises a carriage drive 120, and a frame 110, said frame 110 being provided with a platform 130, typically a chair 130, for carrying a load, typically a human being.

FIG. 10 shows a V-shaped lever arm 140 comprising a first arm member 140' and a second arm member 140".

Figure 1D:
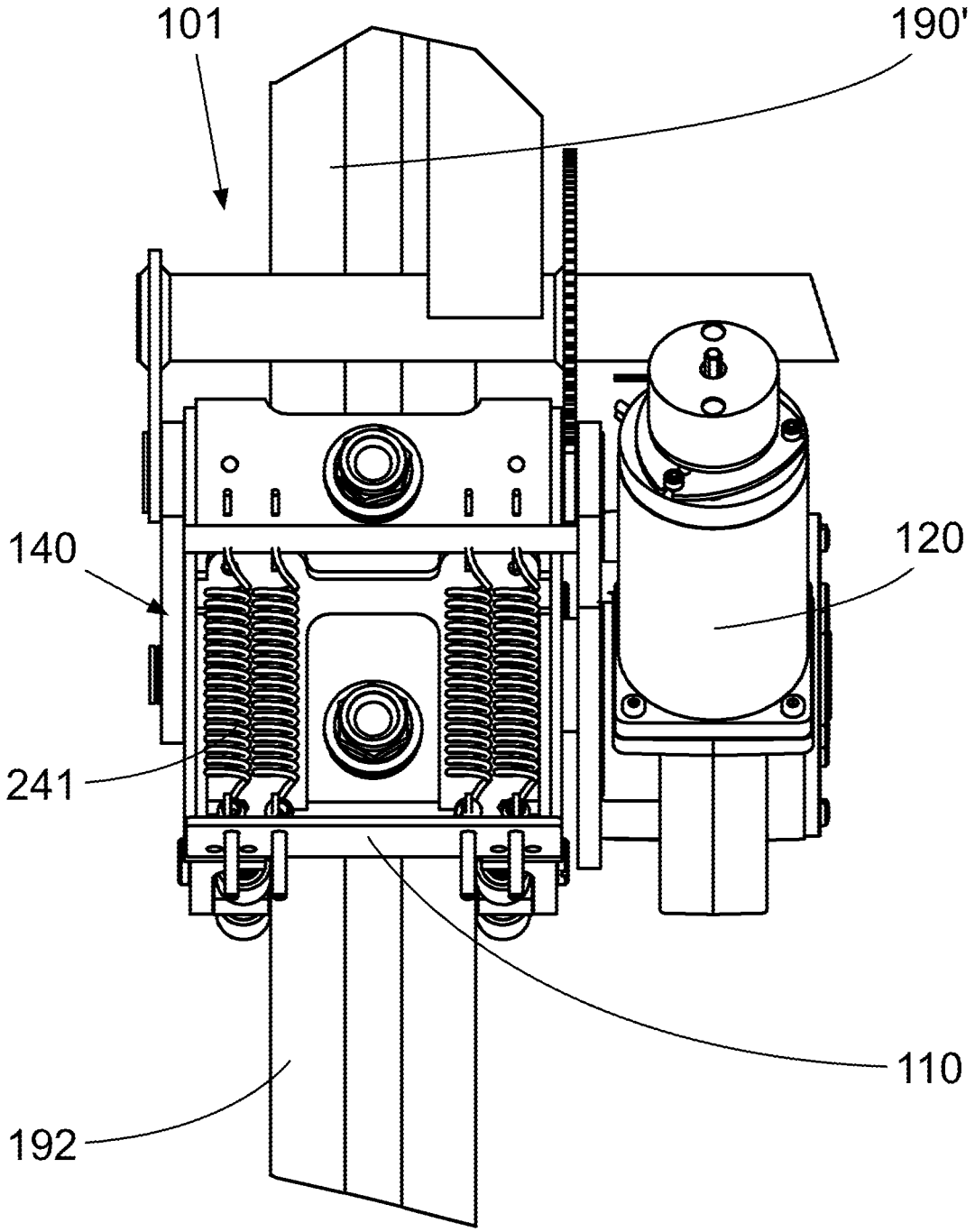

FIG. 1D shows a top view of a detail of stairlift carriage on a stairlift guide of FIG. 1A with the chair 130 removed. The distal end of the second arm member 140" is attached to springs 241 providing a pre-tension to a body of revolution contacting the upper surface 192 of the stairlift guide 190, as will be discussed with reference to FIG. 3.

Figure 2:
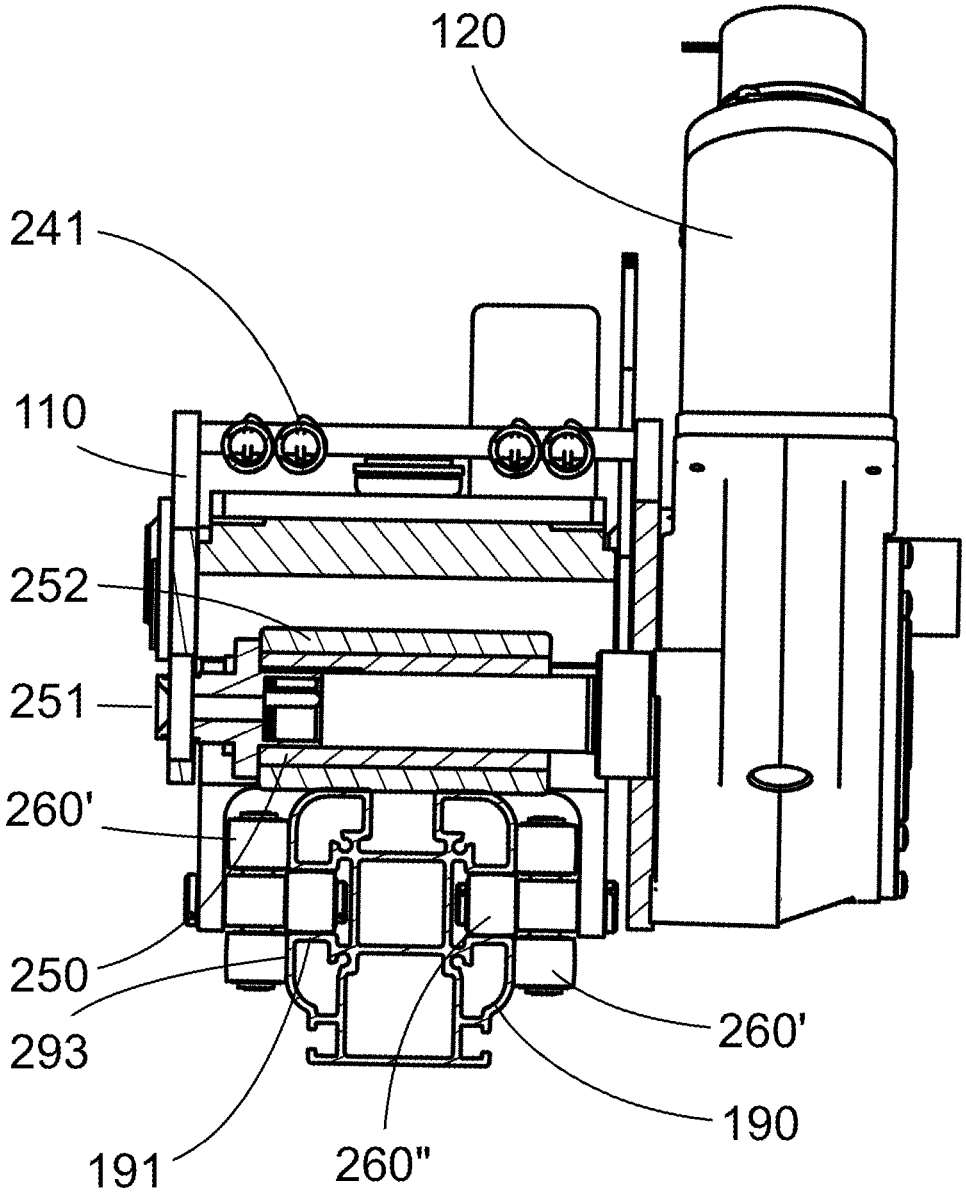
FIG. 2 shows a cross-sectional view on the stairlift carriage of FIG. 1A transverse to the longitudinal direction of the stairlift guide.

FIG. 2 shows a cross-sectional view through the stairlift carriage 100 and through a body of revolution 250, here a friction roll 250 comprising a resilient surface afforded by a rubber layer 252 circumferentially extending at the outside of the friction roll 250. Thus the rubber layer 252 is in contact with the top surface 192 of the stairlift guide 190

In the embodiment discussed here, the carriage drive 120 is an angular drive and drives the friction roll 250. The carriage drive 120 is mounted movably (over a limited angle) to the frame to accommodate for the angular variations of the arm depending on the load.

The frame 110 is provided with first guide wheels 260' which have a vertical axis of rotation if the stairlift carriage 100 is on a horizontal straight section of a stairlift guide 190. The first guide wheels 260' contact the two opposite upright sides 293 of the stairlift guide 190.

The frame 110 is also provided with second guide wheels 260" which are received in the grooves 191 and have a horizontal axis of rotation if the stairlift carriage 100 is on a horizontal straight section of a stairlift guide 190.

Figure 3A:
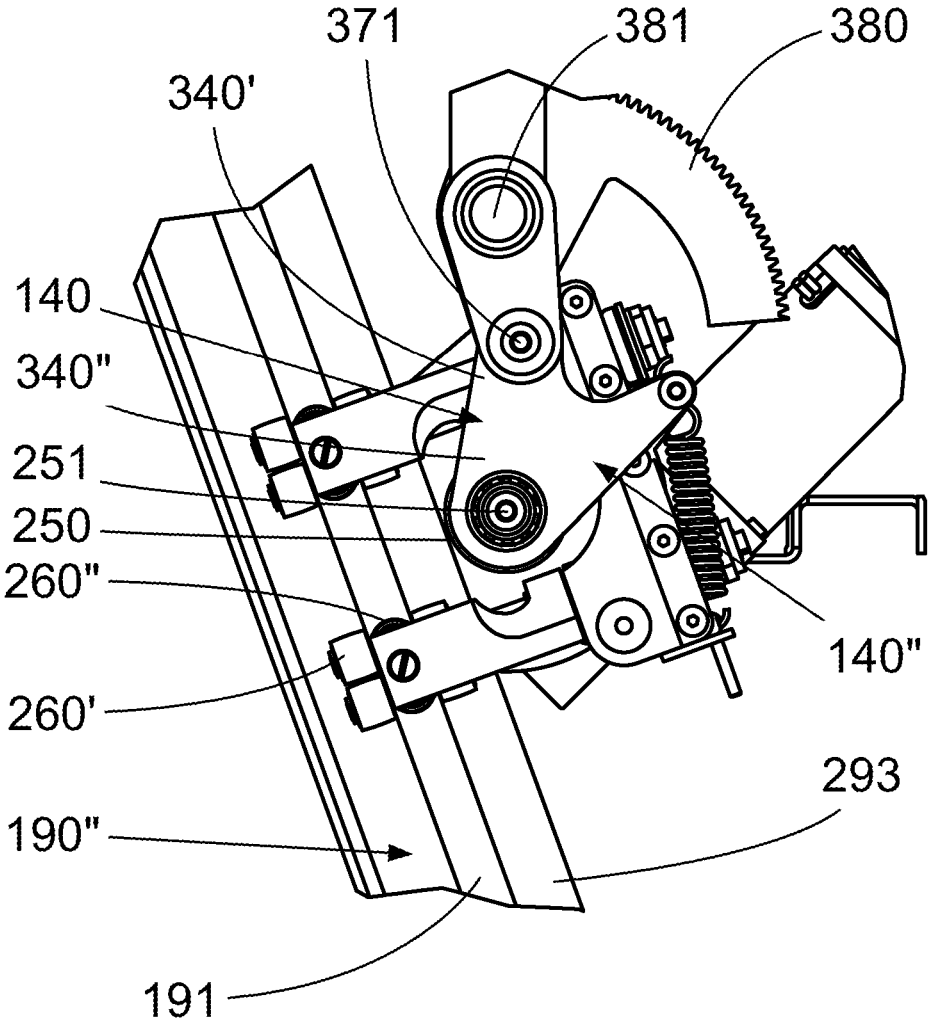
FIG. 3A to FIG. 3B show a detail of the stairway carriage of FIG. 1C in an unloaded and loaded state.
Figure 3B:
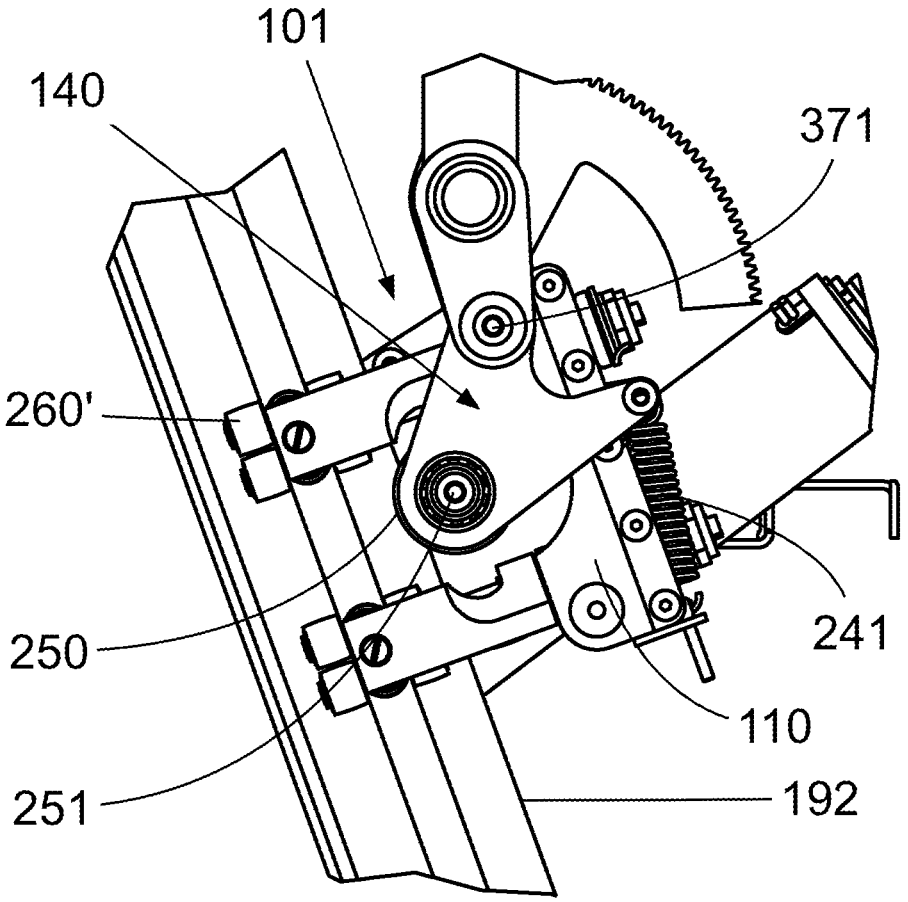

Together the first guide wheels and second guide wheels hold the stairlift carriage 100 on the stairlift guide 190, while allowing it to move along it when driven by the carriage drive 120. FIG. 3A to FIG. 3B show a detail of the stairlift carriage 100 of FIG. 1C in an unloaded and loaded state respectively.

The V-shaped lever arm 140 comprises a first arm member 140' having a primary first arm member section 340' and a secondary first arm member section 340", the lever arm 140 being at the primary first arm member section 340' pivotably about a first axis 371 connected to the frame 110. The friction roll 250 is rotatably about its axis of rotation 251 connected to the secondary first arm member section 340".

The first axis 371 is parallel to the axis of rotation 251 of the friction roll 250.

The first axis 371 is relatively close to the first side 101 and the axis of rotation 251 of the friction roll 250 is relatively far away from the first side 101.

If a stairlift carriage moves over a straight horizontal stairlift guide, lines of contact of the friction roll 250 at two different positions on the stairlift guide defines a horizontal reference plane. The first axis 371 is at a larger distance from the reference plane than the axis of rotation 251 of the friction roll 250. In practice, a line extending from the first axis 371 to the axis of rotation 251 (perpendicular to both said axes) will intersect the reference plane at an angle that is preferably between 40° and 50°.

The V-shaped lever arm 140 comprises a second arm member 140". At a distal end of the second arm member 140", the tension springs 241 pull said distal end and press the friction roll 250 against the top surface 192 of the stairlift guide 190.

To move the stairlift carriage 100 upward on an inclined stairlift guide 190, the friction roll 250 will be driven by the carriage drive 120. If there is no load, the weight of the stairlift carriage 100 and the tension springs 241 exert sufficient pressure on the friction roll 250 so as to allow the stairlift carriage 100 along the stairlift guide.

If there is a load, such as a person, on the stairlift carriage 100 then the frame 110 exerts a force on the first arms section, effectively pressing the friction roll 250 stronger to the upper surface 192 of the stairlift guide 190. The heavier the load, the stronger this force. Thus, there is sufficient friction to safely transport the load, and the energy consumption due to friction will depend on the weight of the load. Thus, no excessive amount of friction is used when the load is not heavy, saving energy.

Toothed wheel section 380 is driven to keep the platform 130 level in case of a stairlift guide 190 having varying inclination. The platform 130 is pivotably mounted about axis 381.

Figure 4A:
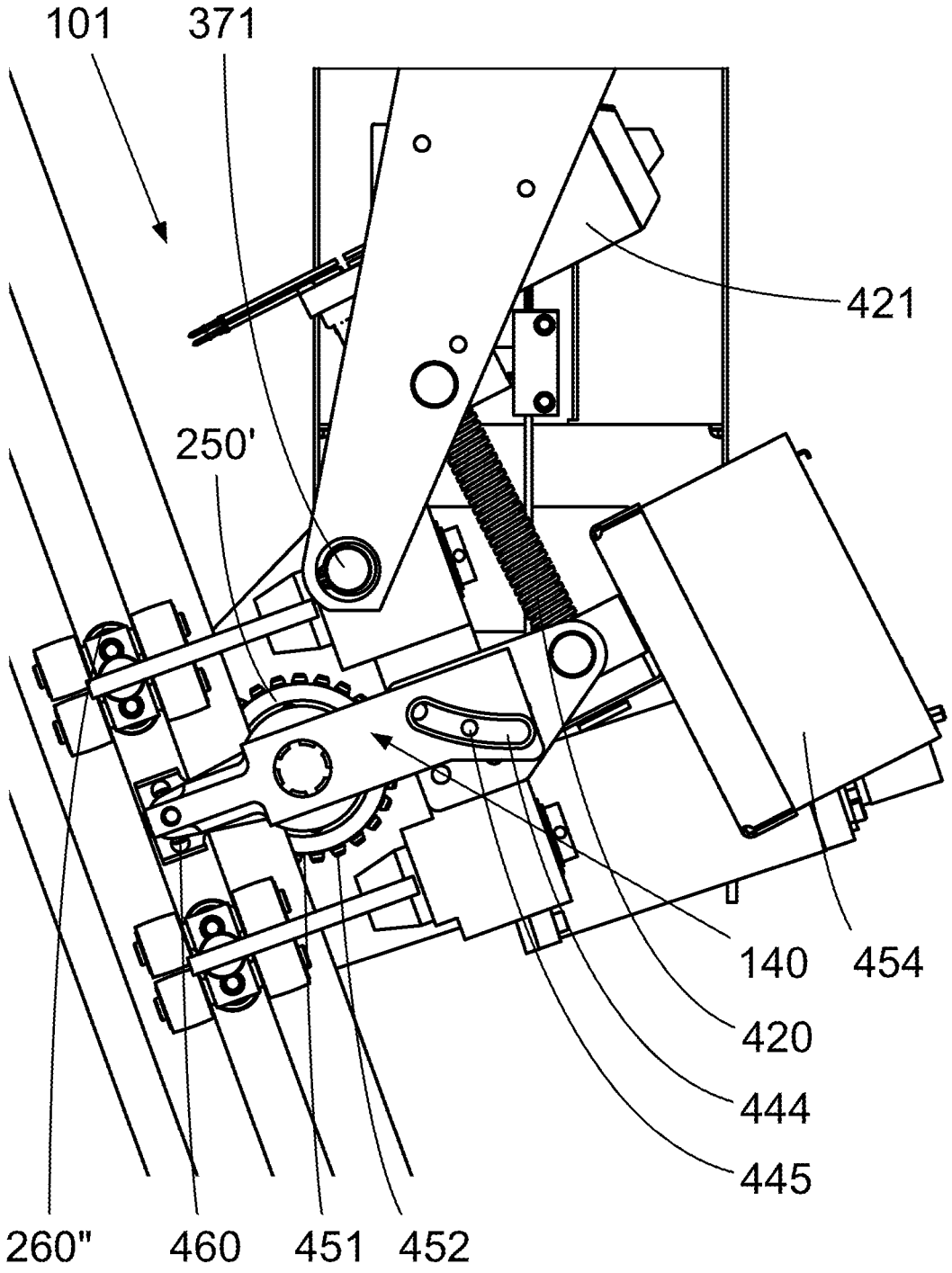
FIG. 4A and FIG. 4B show a detail of an alternative stairway carriage in a side view and a cut-away view respectively.
Figure 4B:
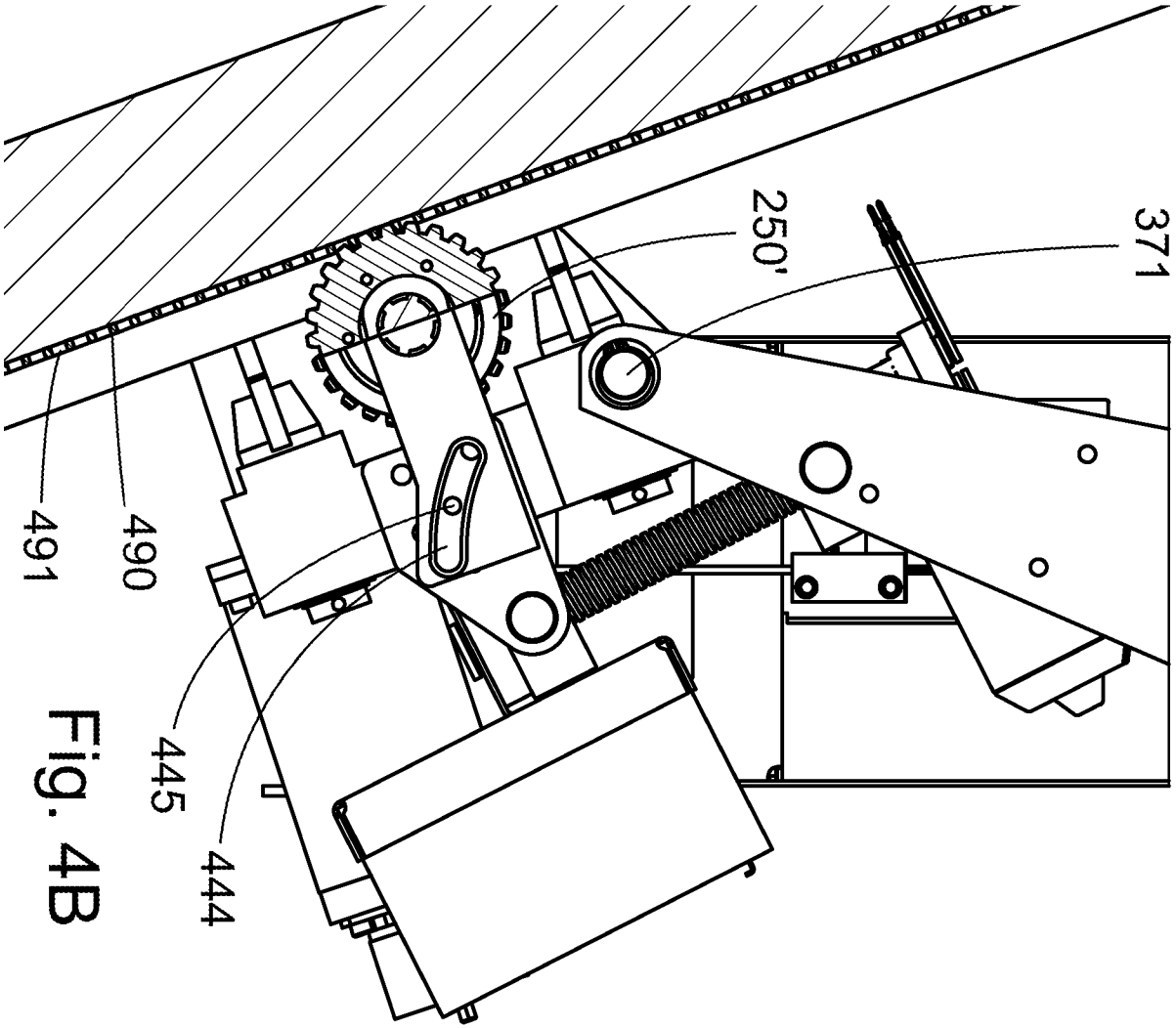

FIG. 4A and FIG. 4B show a detail of an alternative stairway carriage in a side view and a cut-away view respectively. Instead of a friction roll, the body of revolution is a wheel 250' comprising a tread 451, said tread being provided with spaced-apart knobs 452 for engaging a track 490 comprising spaced apart holes 491 for receiving the knobs 452.

The wheel 250' (pinion wheel 250') is driven by carriage drive 120 as discussed above, with the wheel 250' being fixed to an axle 470 with axis of rotation 251, the axle of the wheel 250' being driven by the carriage drive 120.

The arm 140 extends from the frame 110 transverse to the reference plane.

The frame 110 comprises a first frame section 410' running parallel to a direction defined by the first side 101 and the second side 102 of the stairlift carriage and a second frame section 410" extending transverse to the first frame section 410'.

In this embodiment, the platform 130 is kept level using a spindle 420 driven by a motor 421, the spindle 420 passing through a threaded hole in the frame section 410", which is rotatably mounted to the first frame section 410'.

Here, the second frame section 410" also carries a battery pack 454 for powering the motor 421 and the carriage drive 120.

If, by way of example, the stairlift carriage 100 moves horizontally and then up, it is essential that the wheel 250' remains in the track 490. While the weight of the carriage drive 120 hinging about axis 371 helps to keep the wheel 250' and the track 490 engaged, in the embodiment discussed here a more secure measure has been taken. The wheel 250' (together with the carriage drive 120) is mounted on the driven axle 470 between two plates 480, each plate 480 comprising a first plate section 480' and a second plate section 480", the first plate section 480' being provided with a further guide wheel 460, both further guide wheels 460 engaging grooves 191 at opposite sides of the stairlift guide 190. Each of the second plate sections 460" is provided with a guide slot 444 engaging a pin 445 on the first frame section 110.

The distance between the axis of rotation of the further guide wheel 460 and the axis of rotation of the axle 470 is constant. With the wheel 250' being hingeable about the first axis 371, the stairlift carriage might get stuck because the stairlift guide 190 might get knelled between the further guide wheel 460 and the wheel 250'.

The guide slot 444 allows the distance to a line defined by the axes of rotation of the pair of guide wheels 260" engaged in one of the grooves 191 to be varied to a limited extent, restricted by the further guide wheels 460. If a change in inclination is experienced, the guide wheels 260" of a pair of guide wheels 260" don't experience that at the same time. The shape of the slot 444 in the first arm section 140' is chosen such that the wheel 250' can pivot about first axis 371, avoiding the stairlift carriage 100 to become stuck on the stairlift guide 190.

The invention can be varied within the scope of the appended claims. For example, the wheel 250' provided with knobs can be kept in contact with the stairlift guide 190 using tension springs 241. Similarly, the friction roll 250 can be kept in contact with the stairlift guide 190 using the mechanism discussed in reference to FIG. 4A and FIG. 4B. Thus it is ensured that if the stairlift carriage 100 moves horizontally over the stairlift guide 190 in a direction from the first side 101 to the second side 102 that the body of revolution has adequate grip.

Figure 5A:
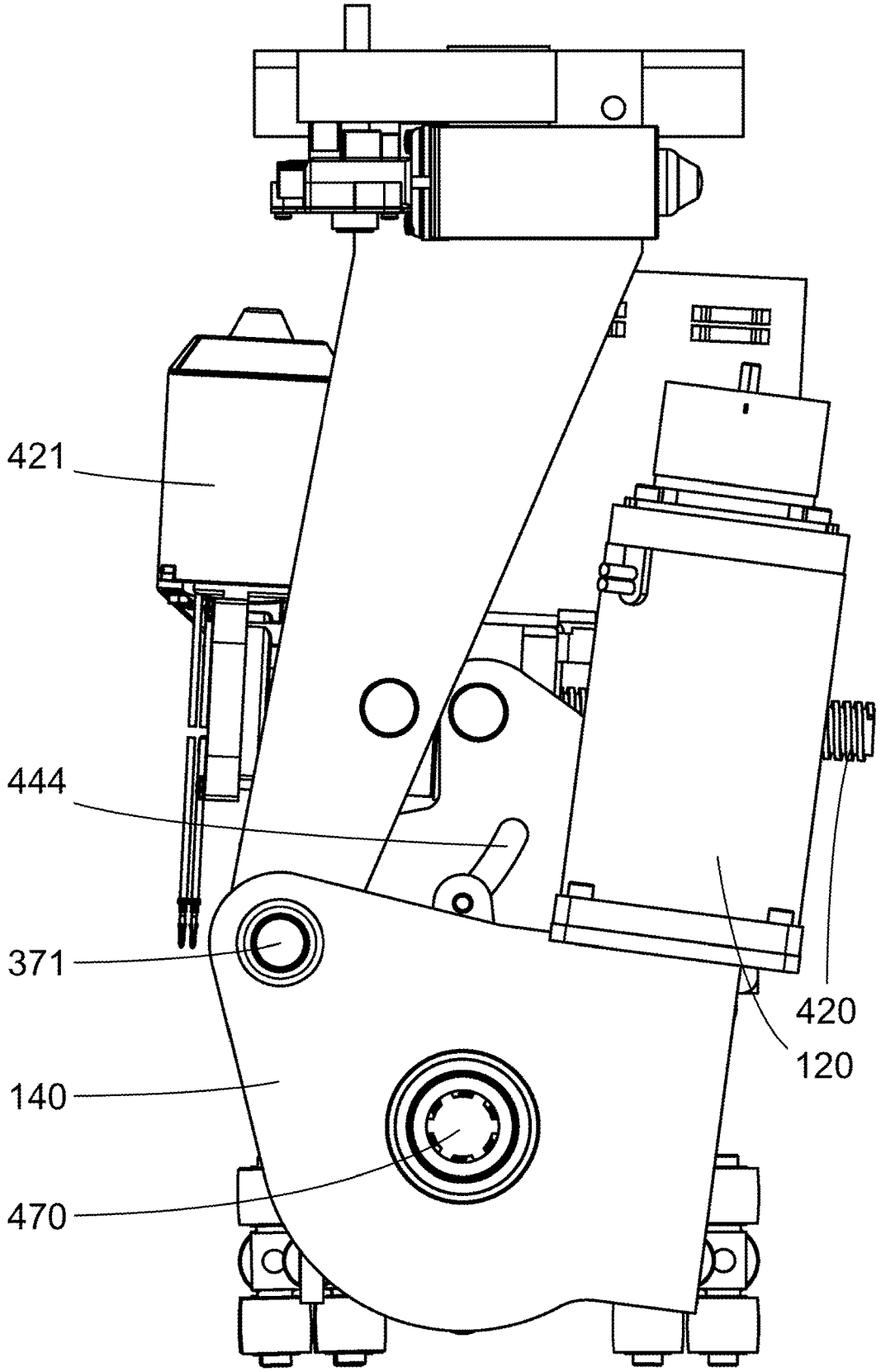
FIG. 5A and FIG. 5B show the alternative stairway carriage of FIG. 4A in two positions of a driven wheel.
Figure 5B:
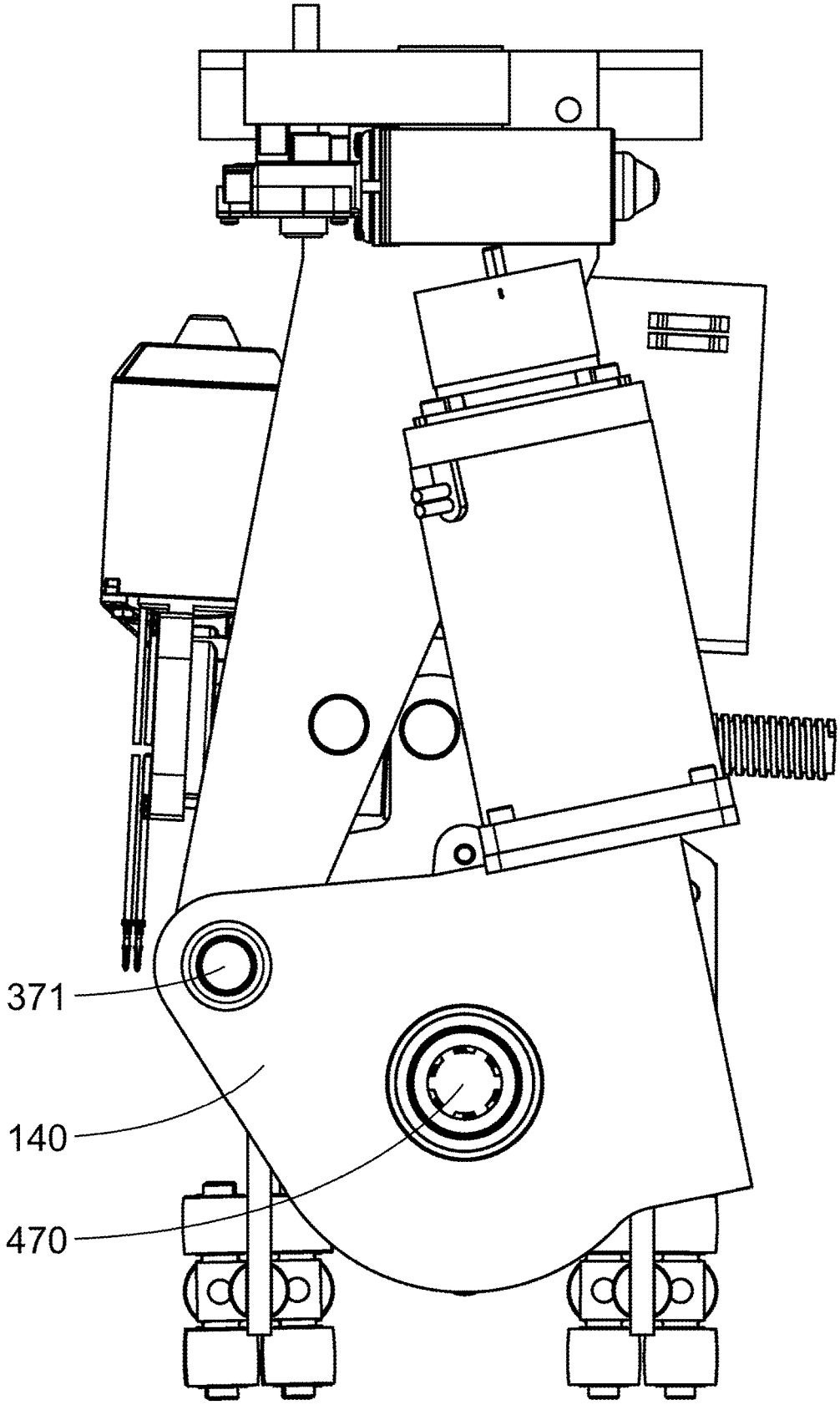

FIG. 5A and FIG. 5B show the alternative stairlift carriage 100 of FIG. 4A in two positions as experienced by the stairlift carriage 100 if it encounters a local change in inclination of the stairlift guide 190.

The arm 140 is now in the form of a plate. It can be seen that the angle between the axis 371 and the axis of rotation of the driven axle 470 is different between FIG. 5A and FIG. 5B to accommodate for passing over a change in inclination of the stairlift guide 190.

The carriage drive 120 to drive the axle 470 is mounted to the arm 140 (the right-angled transmission connecting the motor to the axle 470 is not shown).

Figure 6A:
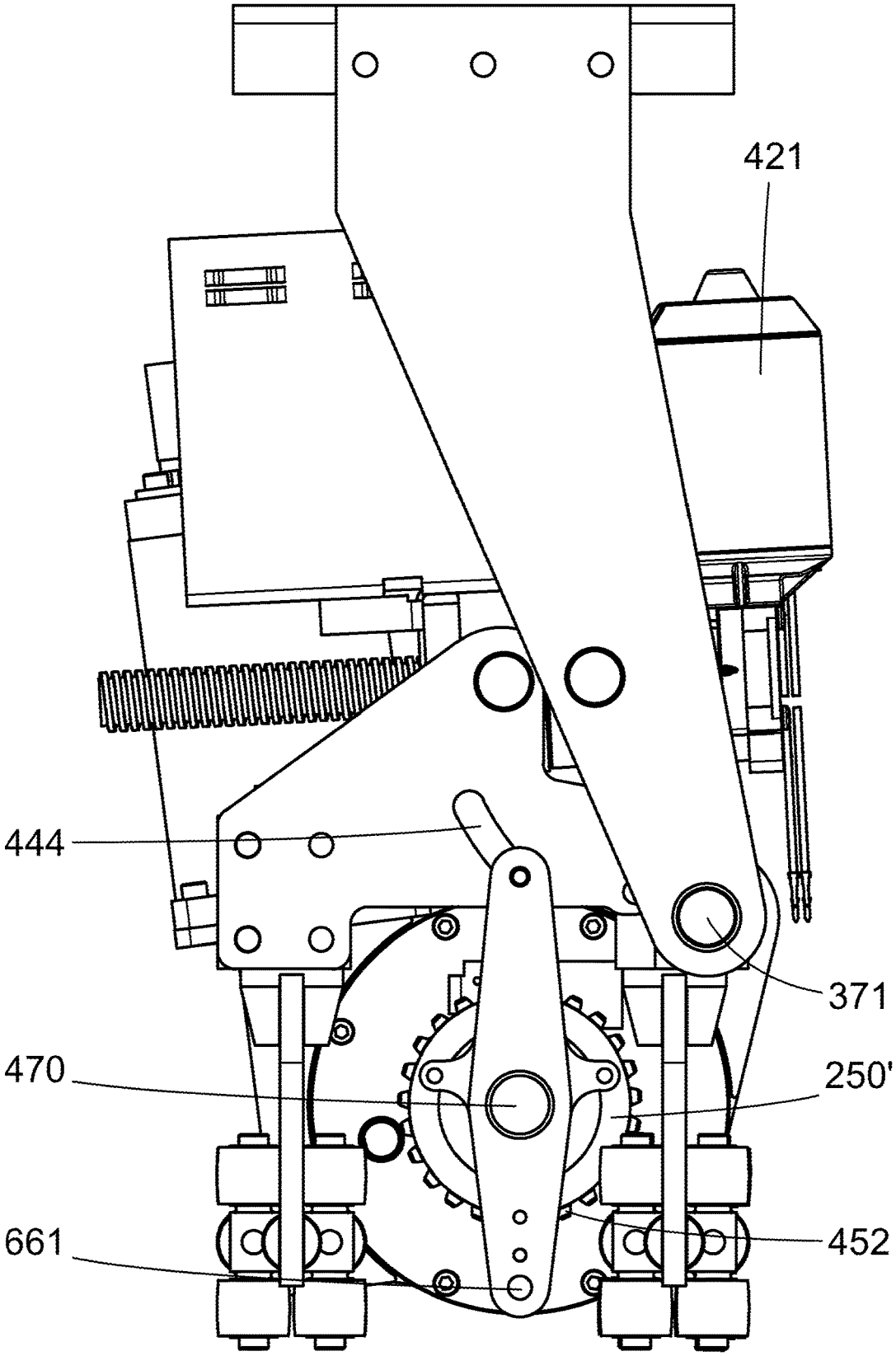
FIG. 6A and FIG. 6B are corresponding opposite side views of FIG. 5A and FIG. 5B.
Figure 6B:
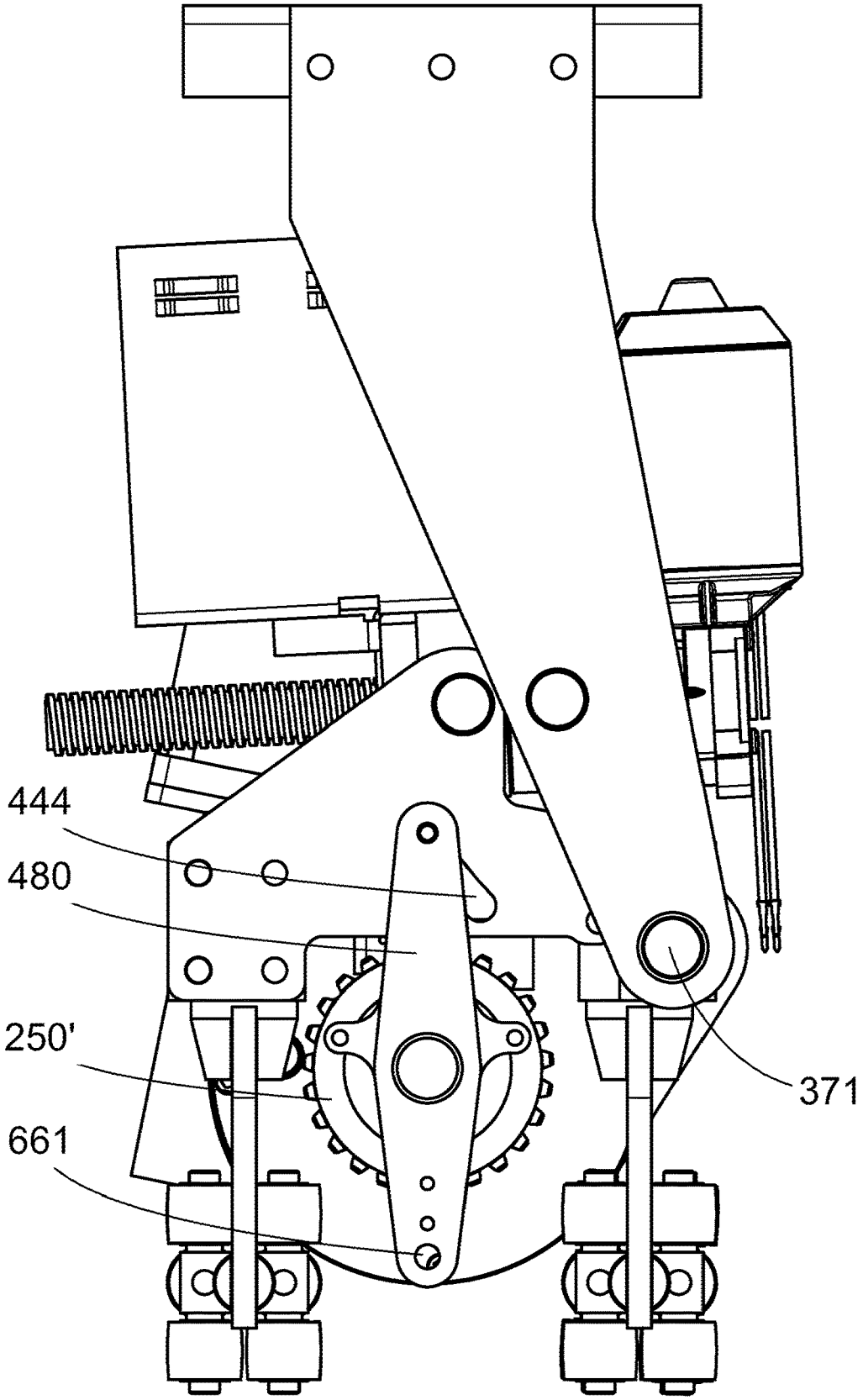

FIG. 6A and FIG. 6B correspond to FIG. 5A and FIG. 5B, see from the opposite side.

The plate 480 comprises a through-hole 661 for mounting the further guide wheel 460 (not shown here).

It can be seen that although the wheel 250' rotates about axis 371, the line between the axis of rotation of the driven axle 470 and the through-hole 661 remains transverse to the reference plane (which runs parallel to a plane defined by the axes of rotation of the second guide wheels 260"), thus reducing the risk that the stairlift carriage might get stuck if the stairlift guide 190 were to get knelled between the further guide wheel 460 and the wheel 250'.

The invention claimed is:

1. A stairlift carriage for moving along a stairlift guide, said stairlift carriage having:

a first side for facing an upwardly inclined stairlift guide section of the stairlift guide, and a second side for facing a downwardly inclined stairlift guide section of the stairlift guide, if the stairlift carriage is mounted on the stairlift guide;

said stairlift carriage comprising:

a carriage drive; and a frame, said frame being provided with:

a platform for carrying a load a pair of guide wheels for following the stairlift guide, said guide wheels being spaced apart in a direction from the first side to the second side of the stairlift carriage; and a body of revolution for moving along the stairlift guide if the stairlift carriage is mounted on the stairlift guide by contact with the stairlift guide and driven by the carriage drive, said body of revolution having an axis of rotation;

wherein:

the frame is provided with an arm having a primary arm section (340') and a secondary arm section, the arm being at the primary arm section pivotably about a first axis connected to the frame and the body of revolution being rotatably about its axis of rotation connected to the secondary arm section, said first axis being parallel to the axis of rotation of the body of revolution;

said first axis is relatively close to the first side (101) and the axis of rotation of the body of revolution is relatively far away from the first side; and the relative positions of the axis of rotation of the body of revolution and of the first axis are chosen such that if the stairlift carriage is mounted on a horizontal straight stairlift guide the first axis is at a larger distance from a reference plane than from the axis of rotation of the body or revolution, wherein said reference plane is defined by:

a first line of contact of the body of revolution with the stairlift guide when the carriage is at a first position on a horizontal straight stairlift guide; and a second line of contact of the body of revolution with the stairlift guide when the carriage is at a second position on the horizontal straight stairlift guide.

2. The stairlift carriage according to claim 1, wherein the arm is at an angle to the reference plane between 30° and 60°.

3. The stairlift carriage according to claim 2, wherein the body of revolution is a wheel comprising a tread, said tread being provided with spaced-apart knobs.

4. The stairlift carriage according to claim 3, wherein the body of revolution is a friction roll.

5. The stairlift carriage according to claim 3, wherein the body of revolution is provided with a pre-tension spring.

6. The stairlift carriage according to claim 3, wherein the stairlift carriage is designed such that if said stairlift carriage is mounted on a straight stairlift guide inclined to the horizontal at an angle α, the first axis is directly above the axis of rotation of the friction roll, wherein α is more than 40° and less than 70°.

7. The stairlift carriage according to claim 3, wherein the friction roll comprises an elastomeric surface for contact with the stairlift guide.

8. The stairlift carriage according to claim 2, wherein the body of revolution is a friction roll.

9. The stairlift carriage according to claim 2, wherein the body of revolution is provided with a pre-tension spring.

10. The stairlift carriage according to claim 2, wherein the stairlift carriage is designed such that if said stairlift carriage is mounted on a straight stairlift guide inclined to the horizontal at an angle α, the first axis is directly above the axis of rotation of the friction roll, wherein α is more than 40° and less than 70°.

11. The stairlift carriage according to claim 2, wherein the friction roll comprises an elastomeric surface for contact with the stairlift guide.

12. The stairlift carriage according to claim 1, wherein the body of revolution is a wheel comprising a tread, said tread being provided with spaced-apart knobs.

13. The stairlift carriage according to claim 12, wherein the body of revolution is a friction roll.

14. The stairlift carriage according to claim 1, wherein the body of revolution is a friction roll.

15. The stairlift carriage according to claim 1, wherein the body of revolution is provided with a pre-tension spring.

16. The stairlift carriage according to claim 1, wherein the stairlift carriage is designed such that if said stairlift carriage is mounted on a straight stairlift guide inclined to the horizontal at an angle α, the first axis is directly above the axis of rotation of the friction roll, wherein α is more than 40° and less than 70°.

17. The stairlift carriage according to claim 1, wherein the friction roll comprises an elastomeric surface for contact with the stairlift guide.

18. A stairlift comprising:

a stairlift guide; and a stairlift carriage according to claim 1, the stairlift carriage being supported by the stairlift guide and moveable along the stairlift guide, said carriage comprising a carriage drive to drive the carriage along the stairlift guide.

19. The stairlift according to claim 18, wherein the pair of guide wheels is a first pair of guide wheels, and the stairlift carriage comprises a second pair of guide wheels opposite of the first pair of guide wheels, the first pair of guide wheels and second pair of guide wheels capable of carrying the stairlift carriage when mounted on a horizontal straight stairlift guide section.

20. The stairlift carriage according to claim 1, wherein the arm is at an angle to the reference plane between 40° and 50°.

* * * * *